US005537708A

United States Patent [19]

Luposello

[11] Patent Number: 5,537,708

[45] Date of Patent: Jul. 23, 1996

[54] TOOTHBRUSH FOR SIMULTANEOUS CLEANING OF BRACE AND TOOTH SURFACES

[76] Inventor: Mark A. Luposello, 11559 Rolling Green Ct., #101, Reston, Va. 22091

[21] Appl. No.: 412,928

[22] Filed: Mar. 29, 1995

[51] Int. Cl.[6] ..... A46B 9/04

[52] U.S. Cl. ..... 15/167.2; 15/160; 15/207.2

[58] Field of Search ..... D4/104, 105; 15/106, 15/160, 167.1, 167.2, 206, 207.2

[56] References Cited

U.S. PATENT DOCUMENTS

| | | | |
|---|---|---|---|
| D. 289,826 | 5/1987 | Tapocik | D4/105 |
| D. 296,271 | 6/1988 | Kobayashi | D4/108 |
| D. 315,450 | 3/1991 | Wagner | D4/106 |
| D. 324,310 | 3/1992 | Barman | D4/106 |
| 1,025,751 | 5/1912 | Kretzschmar | 15/167.2 |
| 1,908,509 | 5/1933 | Davis | 15/167.2 |
| 2,206,542 | 7/1940 | Arnold | 15/167.1 |
| 2,232,269 | 2/1941 | Reuben | 15/106 |
| 3,091,789 | 6/1963 | Haracz | 15/167.2 |
| 3,398,421 | 8/1968 | Rashbaum | 15/167.2 |
| 4,317,463 | 3/1982 | Massetti | 15/167.2 |
| 5,119,522 | 6/1992 | Potts | 15/167.1 |
| 5,327,607 | 7/1994 | Wagner | 15/167.2 |

FOREIGN PATENT DOCUMENTS

| | | | |
|---|---|---|---|
| 108461 | 1/1925 | France | 15/167.1 |
| 117317 | 1/1927 | Switzerland | 15/167.1 |
| 26407 | of 1905 | United Kingdom | 15/207.2 |

*Primary Examiner*—David Scherbel
*Assistant Examiner*—Terrence R. Till
*Attorney, Agent, or Firm*—Oliff & Berridge

[57] ABSTRACT

A toothbrush and orthodontic appliance cleaning device has a multi-surface cleaning head positioned longitudinally at one end of a handle. The head is comprised of two elongate brush members attached at one end to a first surface of the handle. The elongate brush members run parallel to the longitudinal axis of the handle and closely oppose ends of a plurality of bristle bunches projecting transversely from the head. The elongate brushes are not attached to the head or handle at one end, enabling them to pass beneath the orthodontic wires and clean interproximal to the brace assembly. The plurality of bunches can clean the brace surface. The relationship between the free ends of the conventional bristle tufts and the elongate brushes provide both accurate guidance of the brush head along the orthodontic appliance. The relationship further permits comprehensive cleaning of brace, tooth, and gingival surfaces in two basic motions.

21 Claims, 3 Drawing Sheets

TOOTHBRUSH FOR SIMULTANEOUS CLEANING OF BRACE AND TOOTH SURFACES

BACKGROUND OF THE INVENTION

1. Field of the Invention

The invention relates to toothbrushes, specifically to a toothbrush for a person wearing an orthodontic appliance. The toothbrush permits the simultaneous cleaning of the orthodontic appliance and adjacent tooth surfaces and gingiva.

2. Description of Related Art

Related prior art of toothbrushes for general cleaning of bare tooth surfaces is quite extensive. The prior art relating to the cleansing of intraoral foreign materials, such as dentures, bridgework, or orthodontic appliances is not as extensive.

Swiss Patent No. 117,317 describes a brush for cleaning dentures having an extra wide head including two longitudinal bristle rows and two clasp cleaning brushes extending from the forward end of a head. The relationship of the clasp brushes to the bristle rows indicates that this brush was not intended for intraoral use. Attempting to use this brush for intraoral purposes would likely risk injury to the soft tissue structures of the oral cavity.

U.S. Design Pat. No. 289,826 to Tapocier and U.S. Design Pat. No. 296,271 to Kobayashi, both disclose toothbrush designs having a conventional head at one end of a handle and an interproxbrush located at a distant point on the handle. While these designs make it possible to clean an interior of an orthodontic wire, the remote positioning of the brushes results in numerous and awkward manipulations of the toothbrush handle and lengthy time allotment to effectively clean the brace/tooth interfaces.

U.S. Pat. No. 5,327,607 to Wagner discloses a toothbrush for cleaning multiple sides of teeth. The head of the toothbrush is made up of three components, including a spine and two angled side panels, all of which include bristle bunches projecting toward different tooth surfaces. It does not provide means for cleaning interior or gingival to an orthodontic appliance.

U.S. Pat. No. 4,317,463 to Massetti discloses a toothbrush including a head with multiple parallel cleaning swabs set into a carrying body for cleaning of lingual tooth surfaces.

U.S. Pat. No. 5,119,522 to Potts describes a toothbrush having a standard elongate handle with a conventional head for cleaning bare tooth surfaces. A recessed area on an opposite side of the handle cleans the brace surfaces. The toothbrush also contains a removable component with planar bristles utilized for cleaning in between the braces and under an orthodontic wire. The transverse orientation of the brace cleaning slot requires an unnatural brushing motion which would increase the propensity for brace dislodgement if angled improperly.

As is evidenced in the prior art, there is significant need for a new and improved toothbrush which can be easily manufactured and provides for the efficient cleansing of orthodontic appliances and surrounding tooth structures.

SUMMARY OF THE INVENTION

An objective of the invention is to provide a toothbrush for cleaning orthodontic braces and the surrounding tooth structure to which the braces are attached. With regard to the known disadvantages of the prior art, the current invention provides a multibrush relationship capable of comprehensive brace cleaning in two easy motions.

The invention achieves its objectives by providing a toothbrush having a modified conventional head at the end of an elongate handle. The head is comprised of both a plurality of bristle bunches projecting in a direction transverse to a planar spine and two elongate brushes positioned longitudinally on top of the bristle bunch free ends. The elongate brushes are parallel with the long axis of the handle. The relationship provides the advantages necessary for efficient cleansing of the teeth and brace, while eliminating the additional cleaning efforts and awkward manipulations of the toothbrush, inherent in the prior art. The toothbrush according to the invention has its brace cleaning elements orientated longitudinally thus permitting utilization of familiar horizontal and vertical brushing motions. The toothbrush also incorporates flexible elongate brush elements to avoid bracket breakage. The toothbrush also permits simultaneous cleansing of all tooth/brace surfaces and adjacent gingiva with minimal effort by means of two basic motions.

The head of the toothbrush according to an embodiment of the invention consists of a longitudinally shortened head for easy maneuverability around the orthodontic appliances. The bristle bunches on the head are shorter in length than standard bristle bunches. The bristle bunches have a stiffness sufficient for a dual function of: (1) cleaning metal/ceramic brace surfaces and wires of an orthodontic appliance which they contact and (2) supporting the brush head at the proper height to allow consistent and predictable contact between the elongate brushes and the tooth/brace interface.

The elongate brushes of the toothbrush brush members each have a proximal end attached to the handle adjacent to the head. The distal ends of the elongate brush members extend freely from the attachment along the surface of the bristle bunches. The free-ended design enables the elongate brushes to pass underneath orthodontic wires and clean interiors of the brace apparatus. The relationship between the components of the toothbrush head makes the cleaning of all facial tooth surfaces, all exposed brace and wire surfaces, and proper gingival stimulation possible using two simple brushing motions.

It is another objective of the invention to provide a toothbrush which is capable of thoroughly cleansing an individual bracket, the adjoining tooth surface, and marginal gingival tissues using two strokes, one horizontal and one vertical.

Another objective of the invention is to provide a toothbrush which accomplishes the above objectives while being able to be easily mass produced. This ease of production is provided by combining currently produced elements into a toothbrush and having the elements in a superior relationship to each other. A further objective of the current invention is to provide a brush which is available at a low cost.

These and other objectives are realized through the particular arrangement of the individual parts of the invention, and are further described in the accompanying drawings.

DETAILED DESCRIPTION OF THE PREFERRED EMBODIMENTS

With reference to the drawings in detail, the toothbrush 10 includes an elongate handle 11 having a conventional design. The handle 11 extends in a longitudinal direction along a longitudinal axis 12. The handle has attached a cleaning head 13 at one end.

Figure 3:
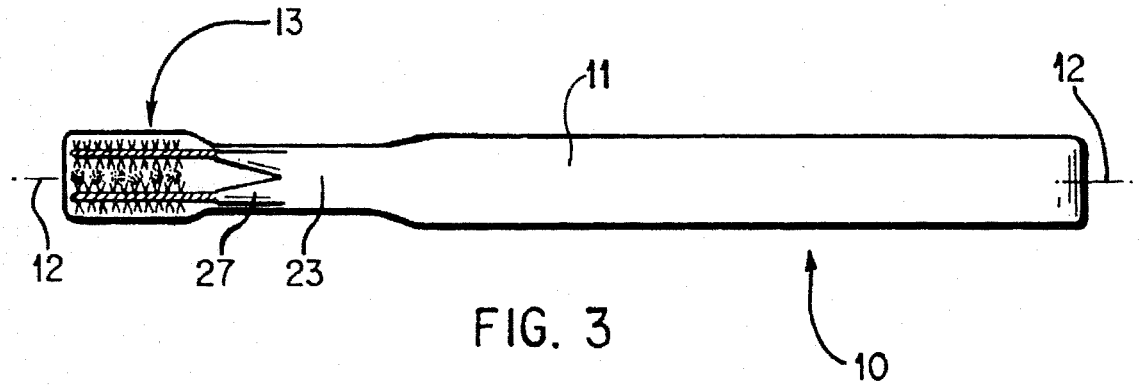
FIG. 3 is a top plan view of the toothbrush according to the present invention.
Figure 4:
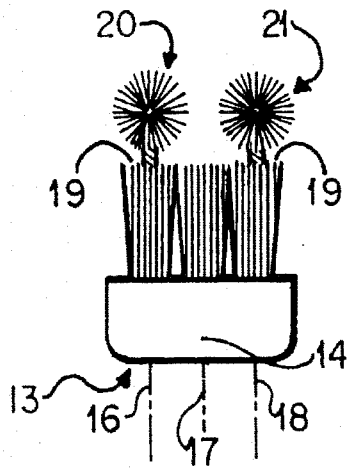
FIG. 4 is an enlarged scale end view of the head of the toothbrush according to the present invention.
Figure 6:
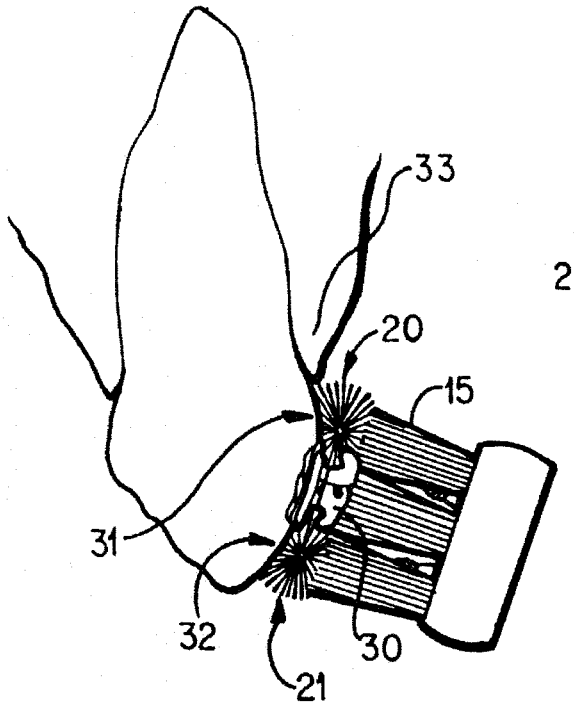
FIG. 6 is an enlarged scale end view of the toothbrush head in contact with the brace and tooth during the horizontal brushing stroke.
Figure 7:
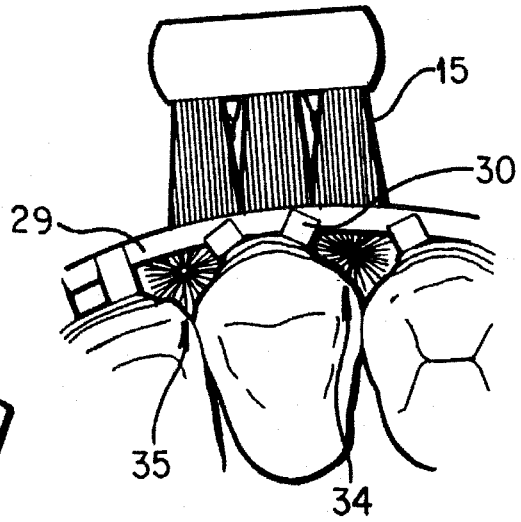
FIG. 7 is an enlarged scale end view of the toothbrush head in contact with the brace and adjacent teeth during the vertical brushing stroke.

As seen in FIGS. 3 and 4, the head 13 is made up of a planar spine 14. The spine 14 has a plurality of orthogonally projecting bristle bunches 15. The bristle bunches 15 define a plurality of rows 16, 17 and 18. Although three rows are shown, any number of rows could be provided. The rows 16, 17 and 18 are parallel to one another and also parallel to the longitudinal axis 12 of the handle 11. The bristle bunches 15 are generally 30% shorter in length than standard toothbrush bristles. The bristle bunches 15 have an increased stiffness to guide the head 13 over the braces and scrub their metallic parts of the braces as shown in FIGS. 6 and 7. The bristles which make up these bristle bunches 15 are of uniform length and terminate in a free end 19.

The head 13 also includes two elongate brushes 20 and 21. The brushes 20, 21 are attached to the handle 11 at its neck 23. The elongate brushes 20, 21 project parallel to one another and to the longitudinal axis 12, while in close proximity to the free ends 19 of the bristle bunches 15. While the elongate brushes 20, 21 are attached to the handle at their proximal end 24, the opposite or distal end 25 remains free floating to permit passage of the elongate brush under the wire 29, as seen in FIG. 7.

Figure 1:
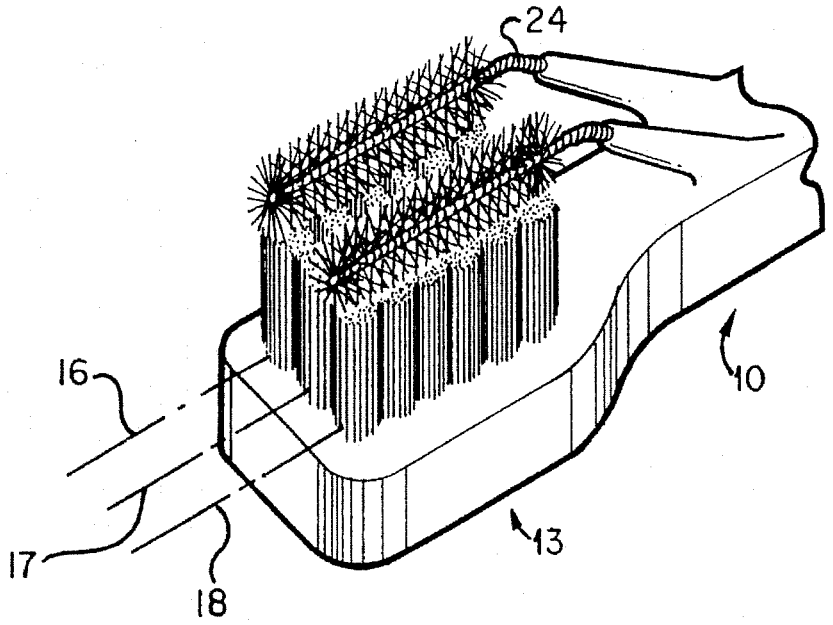
FIG. 1 is an isometric illustration of a toothbrush according to one embodiment of the invention.
Figure 2:
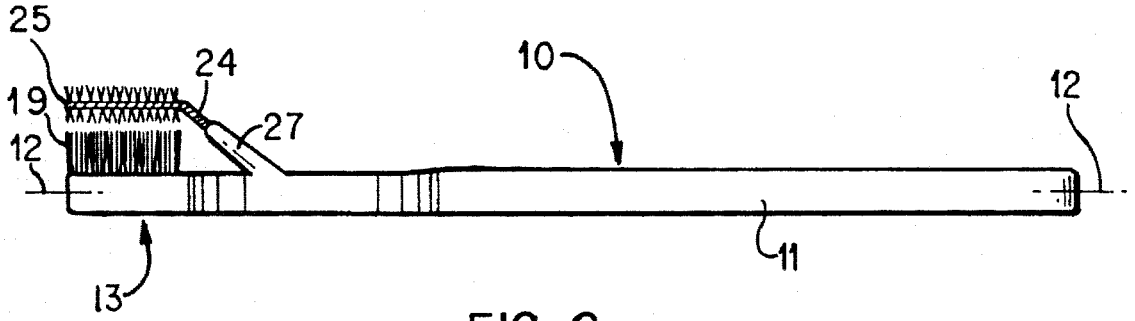
FIG. 2 is a side view of the toothbrush according to the present invention.

Each elongate brush 20, 21 is of known construction and has a maximum diameter of generally 5 mm. Each elongate brush includes a support, for example a braided spiral wire 26. The elongate brushes 20, 21 emanate from a support. The support includes an extension 27 of the neck 23 of the handle. The extension 27 protrudes from the neck at an approximate angle of 45 degrees. Each elongate brush 20, 21, upon exiting from the extension 27, bends at approximately 45 degrees to remain parallel to the axis 12, as seen in FIG. 2.

Figure 5:
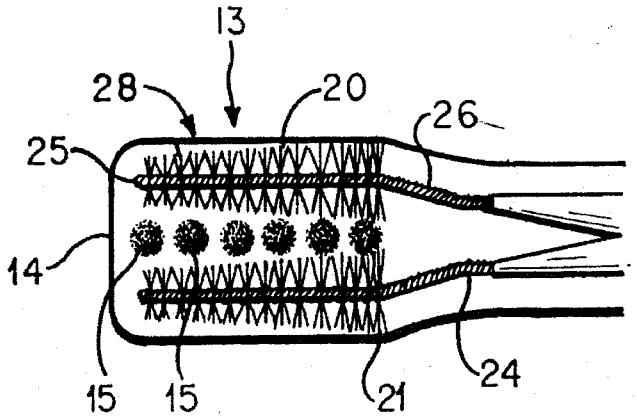
FIG. 5 is an enlarged scale top plan view of the head of the toothbrush according to the present invention utilizing cylindrical elongate brushes.
Figure 8:
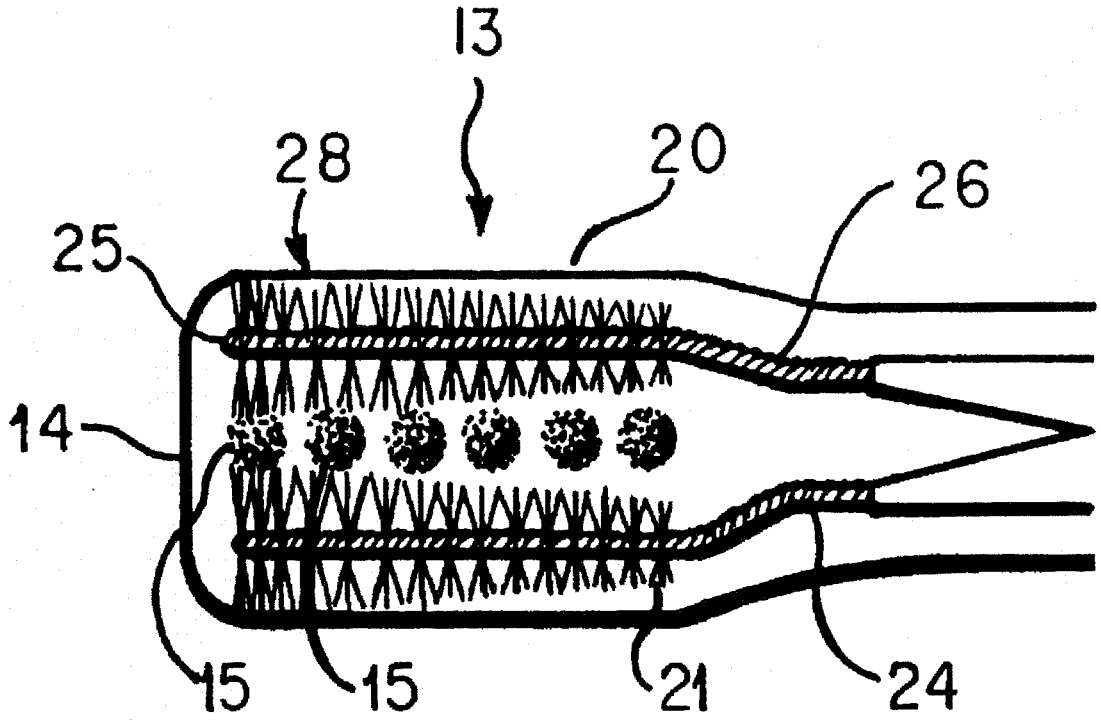
FIG. 8 is an enlarged top plan view of he head of the toothbrush with the tapering brushes narrowing toward the opposite end of he body.

As is seen in FIG. 5, each elongate brush 20, 21 may have a conical or tapering shape 28. Elongate brushes 20, 21 may have a multiplicity of other shapes, such as cylindrical. The conventional head 13 may also have a multiplicity of shapes. The bristle bunches 15 and the elongated brushes 20, 21 each have predetermined stiffnesses. The stiffnesses can be equal to each other or different. For example, the plurality of bristle bunches can have a first stiffness and the at least one elongate brush can have a second stiffness less than the first stiffness. The invention encompasses all equivalent relationships to those disclosed in the Figures and set forth herein. For example in FIG. 8, the elongated brushes 20', 21' taper toward the opposite end of the body. In FIG. 8 like elements are represented by the same reference characters.

The use of the above-described toothbrush will be described with respect to the Figures.

With reference to FIG. 6, a horizontal brushing motion is illustrated. The head 13 of the toothbrush 10 engages an orthodontic appliance 30 during a horizontal brushing motion. The free ends 19 of the bristle bunches 15 contact the brace and wire surfaces. The elongate brushes 20, 21 contact the brace underside. The brushes 20, 21 contact and stimulate the gingival tooth surface 31, the occlusal tooth surface 32, and the marginal gingiva 33.

With reference to FIG. 7, a vertical brushing motion is illustrated. The head 13 of the toothbrush 10 engages the orthodontic appliance during a vertical brushing motion. The bristle bunches 15 clean the brace 30 and wire 29 surface. The elongate brushes 20, 21 clean the underside of the wire. The brushes 20, 21 contact and stimulate the mesial 34 and distal 35, tooth surfaces 32, and interdental gingiva.

The materials which make up the bristles, the interproxybrushes, and the handle are of conventional design. These materials may also vary within a considerable range of materials known in the art. Such changes and alterations shall be considered to be within the scope of the invention.

While this invention has been described in conjunction with specific embodiments thereof, it is evident that many alternatives, modifications and variations will be apparent to those skilled in the art. Accordingly, the preferred embodiment of the invention as set forth herein are intended to be illustrative, not limiting. Various changes may be made without departing from the spirit and scope of the invention as defined in the following claims.

What is claimed is:

1. A toothbrush, comprising:

a brush body defining a longitudinal direction and having a head at one end and a handle at an opposite end, the head having a bristle side;

a plurality of upstanding bristle bunches extending from the bristle side of the head in a direction transverse to the longitudinal direction; and at least one elongate brush supported on the bristle side of the head and having a brush periphery and a centerline which extends along the longitudinal direction of the brush body, said brush periphery surrounding said centerline, the at least one elongate brush being positioned above the plurality of bristle bunches to permit free access to the entire brush periphery of the at least one elongate brush.

2. A toothbrush according to claim 1, wherein the at least one elongate brush comprises at least two elongate brushes.

3. A toothbrush according to claim 2, wherein the at least two elongate brushes extend generally parallel to each other.

4. A toothbrush according to claim 1, wherein the at least one elongate brush is a conically shaped brush.

5. A toothbrush according to claim 4, wherein the conically shaped brush narrows toward the one end of the body.

6. A toothbrush according to claim 4, wherein the conically shaped brush narrows toward the opposite end of the body.

7. A toothbrush according to claim 1, wherein the at least one elongate brush is a tapered brush.

8. A toothbrush according to claim 7, wherein the tapered brush narrows toward the one end of the body.

9. A toothbrush according to claim 7, wherein the tapered brush narrows toward the opposite end of the body.

10. A toothbrush according to claim 1, wherein the plurality of bristle bunches have a first stiffness and the at least one elongate brush has a second stiffness less than the first stiffness.

11. A toothbrush according to claim 1, wherein the plurality of bristle bunches defines at least two rows of bristle bunches longitudinally aligned on the head and wherein there are at least two elongate brushes, each brush of the at least two elongate brushes is generally aligned with one row of the at least two rows and generally parallel to each other.

12. A toothbrush according to claim 11, wherein there are at least three rows.

13. A toothbrush according to claim 1, further including a support for supporting the at least one elongate brush above the plurality of bristle bunches, the support positioned on the body between the plurality of bristle bunches and the opposite end of the body.

14. A toothbrush according to claim 13, wherein the at least one elongate brush is supported at one end by the support and the other end of the at least one elongate brush is a free end.

15. A toothbrush according to claim 1, wherein the at least one elongate brush is a cylindrical brush.

16. A toothbrush for cleaning a tooth surface and an orthodontic appliance attached to the tooth surface, comprising:

a brush body defining a longitudinal direction and having a head at one end and a handle at an opposite end, the head having a bristle side;

a plurality of upstanding bristle bunches extending from bristle side of the head in a direction transverse to the longitudinal direction;

at least two conically shaped elongate brushes supported on the bristle side of the head and each having a brush periphery and a centerline extending along the longitudinal direction of the brush body, each centerline being positioned above the plurality of bristle bunches wherein free access to the entire brush periphery of each of the at least two concisely shaped elongate brushes is permitted.

17. A toothbrush according to claim 16, wherein the conically shaped brush narrows toward the one end of the body.

18. A toothbrush according to claim 16, wherein the conically shaped brush narrows toward the opposite end of the body.

19. A toothbrush according to claim 16, wherein the plurality of bristle bunches have a first stiffness and the at least two elongate brushes have a second stiffness less than the first stiffness.

20. A toothbrush according to claim 16, wherein the plurality of bristle bunches define at least two rows longitudinally aligned on the head and wherein the at least two elongate brushes are generally aligned with one row of the at least two rows and generally parallel to each other.

21. A toothbrush according to claim 16, further comprising at least two supports that support, a corresponding one of each of the at least two brushes above the plurality of bunches, the support positioned on the body between the plurality of bristle bunches and the opposite end of the body.

* * * * *